US008123597B2

(12) United States Patent
Chiu et al.

(10) Patent No.: US 8,123,597 B2
(45) Date of Patent: Feb. 28, 2012

(54) POLISHING PAD

(75) Inventors: Allen Chiu, Tao-Yuan Hsien (TW); Shao-Yu Chen, Tao-Yuan Hsien (TW); Yu-Lung Jeng, Tao-Yuan Hsien (TW)

(73) Assignee: Bestac Advanced Material Co., Ltd., Tao-Yuan Hsien (TW)

( * ) Notice: Subject to any disclaimer, the term of this patent is extended or adjusted under 35 U.S.C. 154(b) by 487 days.

(21) Appl. No.: 12/325,376

(22) Filed: Dec. 1, 2008

(65) Prior Publication Data

US 2010/0105303 A1 Apr. 29, 2010

(30) Foreign Application Priority Data

Oct. 23, 2008 (TW) ..... 97218906 U

(51) Int. Cl.
*B24B 7/22* (2006.01)

(52) U.S. Cl. ..... 451/527; 451/548; 451/921

(58) Field of Classification Search ..... 451/527, 451/530, 533, 548, 921
See application file for complete search history.

(56) References Cited

U.S. PATENT DOCUMENTS 3,498,010 A * 3/1970 Hagihara Nobuyoshi .... 451/527
5,177,908 A 1/1993 Tuttle
5,212,910 A 5/1993 Breivogel et al.
5,232,875 A 8/1993 Tuttle et al.
5,257,478 A 11/1993 Hyde et al.
5,287,663 A 2/1994 Pierce et al.
5,297,364 A 3/1994 Tuttle
5,302,233 A 4/1994 Kim et al.
5,329,734 A 7/1994 Yu
5,380,546 A 1/1995 Krishnan et al.
5,441,598 A 8/1995 Yu et al.
5,489,233 A 2/1996 Cook et al.
5,578,362 A 11/1996 Reinhardt et al.
5,650,039 A 7/1997 Talieh
5,690,540 A 11/1997 Elliott et al.
6,001,001 A 12/1999 IslamRaja et al.
6,089,966 A 7/2000 Arai et al.
6,120,366 A 9/2000 Lin et al.
6,203,407 B1 3/2001 Robinson
6,648,743 B1 * 11/2003 Burke ..... 451/526
6,783,436 B1 8/2004 Muldowney
6,951,510 B1 * 10/2005 Rodriguez et al. ..... 451/56
7,097,550 B2 8/2006 Kawahara et al.
7,329,174 B2 * 2/2008 Hosaka et al. ..... 451/527
7,357,703 B2 4/2008 Nishimura et al.
7,662,028 B2 * 2/2010 Feng et al. ..... 451/526
2004/0014413 A1 1/2004 Kawahashi et al.
2006/0089093 A1 4/2006 Swisher et al.
2007/0180778 A1 8/2007 Prasad
2008/0139684 A1 6/2008 Swisher et al.

* cited by examiner

*Primary Examiner* — Robert Rose
(74) *Attorney, Agent, or Firm* — Ming Chow; Sinorica, LLC

(57) ABSTRACT

The polishing pad includes a polishing surface, on which is formed with a plurality of first grooves and a plurality of second grooves, wherein the characteristic of the polishing pad is in that: the first grooves are connected to the second grooves, the width of first grooves are larger than that of the second grooves, the depth of first grooves are larger than that of the second grooves, the density of first grooves are larger than that of the second grooves, and the first grooves and the second grooves are uniformly distributed over the polishing surface respectively. Therefore when the polishing step is performed using the polishing pad, smaller scraps produced after polishing or smaller polishing particles in the slurry or more turbid slurry can flow out of the polishing pad via the second groove, and larger scraps or particles can flow out of the polishing pad via the first groove.

13 Claims, 4 Drawing Sheets

POLISHING PAD

BACKGROUND OF THE INVENTION

1. Field of the Invention

The present invention is related to a polishing pad, and more particularly, to a polishing pad with two groove patterns.

2. Description of the Prior Art

Electrical chips are formed by deposition of various laminate materials, for example, a silicon wafer is one of the substrates of laminate materials. Whenever a new laminate is deposited, a polishing or scrapping step is often needed for removing excessive laminate materials to planarize the chip or to achieve other purposes. Such process of polishing is generally called chemical mechanical polishing (CMP). Since chips are formed by deposition of different thin film laminates, the CMP step needs to be performed for multiple times for evenly removing excessive laminate materials from the surface of a chip to achieve the purpose of planarization.

And usually when the CMP step is performed, chemical slurry is led in between the chip and the polishing pad for generating chemical reaction between the deposited thin film laminates and the chemical slurry or for generating mechanical reaction between the deposited thin film laminates and the particles in the chemical slurry to remove part of excessive thin film laminates on the surface of chip. However, the slurry existing between the polishing pad and the chip makes it easy for the polishing pad and the chip to become fully attached to each other, which thus causes disappearance of the force of friction between the polishing pad and the chip. Therefore, in order to achieve better polishing effect with the CMP step, the most common practice at present is to install groove on the surface of the polishing pad not only for increasing force of friction between the polishing pad and the chip but also for ensuring that the slurry is evenly distributed on the surface of the polishing pad and for letting polishing particles suspended in the slurry and the scraps to flow out through the groove.

In prior art, many patents make improvements particularly on the pattern of groove installed on the surface of polishing pad. Taking Taiwan patent No. I250572 for one example, referring to FIG. 1A, groove 11 is formed on the surface side of polishing pad 10, the pattern of which being selected from the group consisting of ring-shape, grid-shape, and helix-shape, FIG. 2A being a sectional view drawn according a-a' sectional line in FIG. 1A; taking Taiwan patent No. 200744786 for another example, referring to FIG. 2, the polishing pad 20 includes two sets of grooves on its surface, one set being the first kind of grooves 21 that intersect a single virtual direct line extending from center of polishing pad 20 to surround, the set of groove 21 does not intersect each other, the other set being the second kind of grooves 22 that extend from central part of polishing surface to the surrounding part, are composed of the second kind of grooves 22 contacting each other at the central part and the second kind of grooves 22 does not contact any other second kind of grooves 22 at the central part, and do not intersect each other.

Although the main objective of the aforementioned patents is to effectively eliminate scratches caused by impurities produced in the interior when the polishing step is performed, yet when the scraps produced after polishing or the polishing particles in the slurry are larger than the groove, they cannot instantly flow out via the groove of polishing pad. And thus the residual polishing particles or deposits will form larger particles and easily cause scratching and damaging of surface of the polished work piece.

SUMMARY OF THE INVENTION

In order to solve the problems as described above, one objective of the present invention is to provide a polishing pad with two kinds of groove patterns. Therefore when the polishing step is performed, smaller scraps or smaller polishing particles or turbid slurry can flow out of the polishing pad via the second groove, and larger scraps or particles can flow out of the polishing pad via the first groove, and thus the polishing particles or deposits will not easily remain on the polishing pad or further cause scratching and damaging of surface of the polished work piece.

Another objective of the present invention is to provide a polishing pad, the design of groove of polishing surface of which facilitates the increase of friction force between the polishing pad and the work piece.

Still another objective of the present invention is to provide a polishing pad, the design of groove of polishing surface of which makes it easy for the slurry to be flung out with the centrifugal force function during the polishing step to prevent polishing particles from remaining or depositing.

Yet another objective of the present invention is to provide a polishing pad, the groove of which ensures that the slurry is evenly distributed on the polishing surface.

According to objectives described above, the present invention provides a polishing pad that includes a polishing surface, on the polishing surface being formed with at least a first groove and at least a second groove, wherein the characteristic of the polishing pad is in that: the first groove and the second groove are connected to each other, and the width of the first groove is larger than that of the second groove, and the depth of the first groove is larger than that of the second groove. Therefore when the polishing step is performed using the polishing pad, smaller scraps or smaller polishing particles or turbid slurry can flow out of the polishing pad via the second groove, and larger scraps or particles can flow out of the polishing pad via the first groove. Thus the polishing particles or deposits will not easily remain on the polishing pad or further cause scratching and damaging of the surface of polished work piece.

BRIEF DESCRIPTION OF THE DRAWINGS

The invention as well as a preferred mode of use, further objectives and advantages thereof will best be understood by reference to the following detailed description of illustrative embodiments when read in conjunction with the accompanying drawings, wherein.

DESCRIPTION OF THE PREFERRED EMBODIMENTS

The present invention discloses a polishing pad, and more particularly, a polishing pad with two kinds of groove patterns. In the present invention, some details for manufacturing or processing polishing pad are achieved by applying conventional art, and therefore are not completely depicted in below description. And the drawings referred to in the following are not made according to the actual related sizes, the function of which is only to express and illustrate characteristics of the present invention.

Figure 1A:
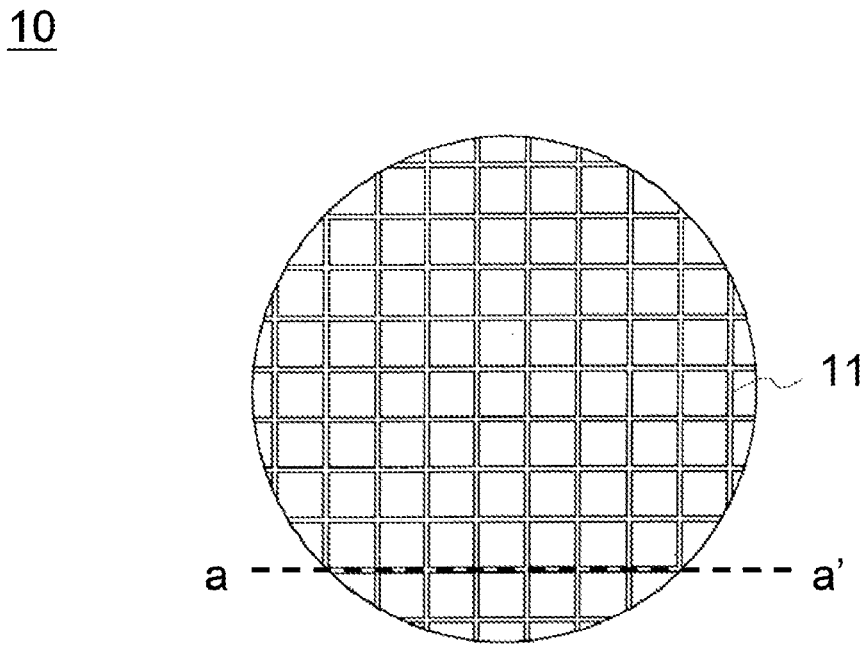
Fig.1A (prior art)
FIG. 1A is a front view of a polishing pad (prior art)
Figure 1B:
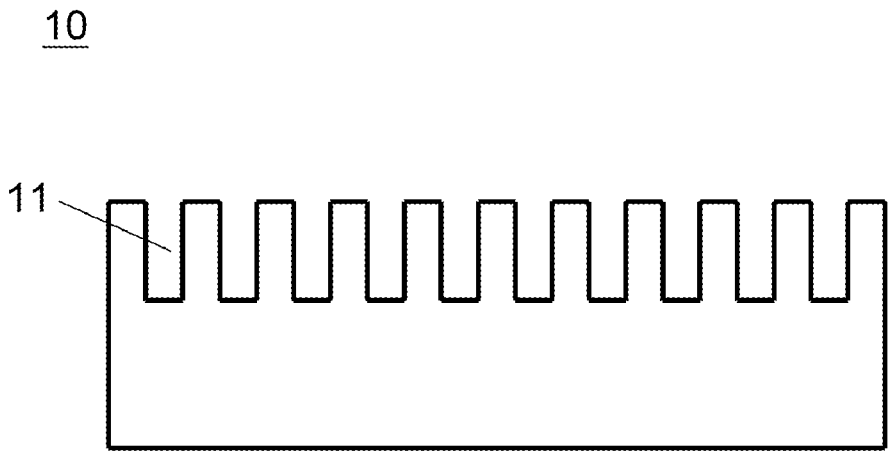
Fig.1B (prior art)
FIG. 1B is a sectional view of a polishing pad taken along sectional line a-a' (prior art)
Figure 2:
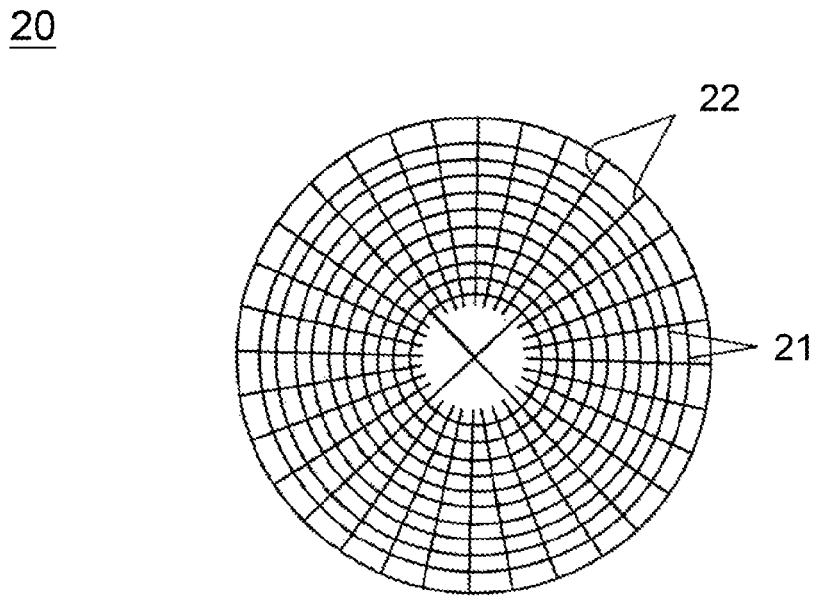
Fig.2 (prior art)
FIG. 2 is a front view of a polishing pad (prior art)
Figure 3A:
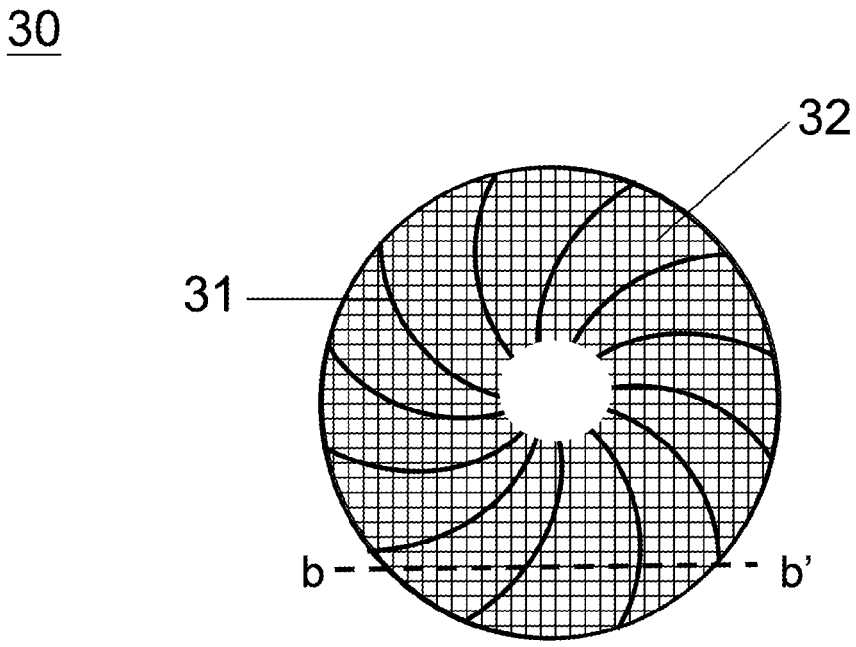
FIG. 3A is a front view of a polishing pad.
Figure 3B:
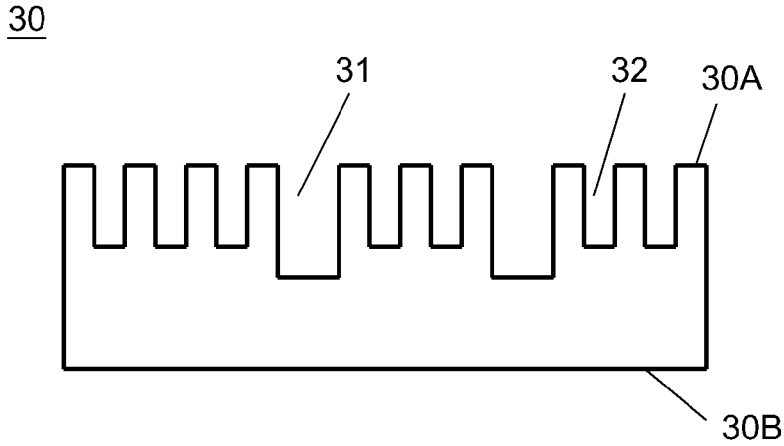
FIG. 3B is a sectional view of a polishing pad taken along sectional line b-b'.

First, referring to FIG. 3A and FIG. 3B, which are views of a preferred embodiment according to the present invention. Shown in FIG. 3A is a polishing pad 30 that includes a polishing surface, 30A (as shown in FIG. 3B), and a plurality of first grooves 31 and a plurality of second grooves 32 are formed on the polishing surface 30A to facilitate the increase of friction force between the polishing pad 30 and the work piece, wherein the characteristic of polishing pad 30 is in that: the first grooves 31 and the second grooves 32 are connected to each other, and the width of the first groove 31 is larger than that of the second groove 32, the depth of the first groove 31 is larger than that of the second groove 32, and the density of the first groove 31 distributed over the polishing surface 30A is smaller than that of the second groove 32, as shown in the sectional view of FIG. 3B. Besides, the first groove 31 and the second groove 32 are uniformly distributed over the polishing surface 30A respectively, as shown in FIG. 3A. Therefore when the polishing step is performed using polishing pad, smaller scraps produced after polishing or smaller polishing particles in the slurry or turbid slurry can flow out of the polishing pad via the second groove, and larger scraps or particles can flow out of the polishing pad via the first groove, and thus the polishing particles or deposits will not easily remain on the polishing pad or further cause scratching and damaging of surface of the polished work piece.

Moreover, one end of first groove 31 and one end of second groove 32 are connected to the periphery of polishing pad 30 respectively, which thus makes it easy for the slurry to be flung out with the centrifugal force function during the polishing step; each of first grooves 31 has a uniform width and a uniform depth, each of second grooves 32 has a uniform width and a uniform depth; the depth of second groove 32 is 0.1 mm~1 mm, with 0.4 mm~0.7 mm being preferred embodiment, and the depth of first groove 31 is 0.2 mm~1.5 mm, with 0.5 mm~1.2 mm being preferred embodiment, therefore the depth of first groove 31 is larger than that of the second groove 32; the polishing pad 30 of the present invention further includes a connecting surface 30B (as shown in FIG. 3B) for being connected to a polishing surface of another polishing pad to form a multi-layer polishing pad laid up by a plurality of layers of polishing pads.

Then, referring to FIG. 3A, which is a view of a preferred embodiment of first groove of polishing pad according to the present invention. As shown in FIG. 3A, the first groove 31 is disposed on the polishing pad 30 with the center of circle of polishing pad 30 as center in curved radiation toward the periphery of polishing pad 30, the first groove 31 and the second groove 32 are uniformly distributed over the polishing surface 30 respectively, and is thus able to make it easy for the slurry to be flung out with the centrifugal force function during the polishing step to prevent the polishing particles from remaining or depositing; the second groove 32 is disposed on the polishing pad 30 in grid pattern to ensure that the slurry can be evenly distributed on the polishing surface for forming a polishing pad 30 with two kinds of groove patterns.

Figure 4:
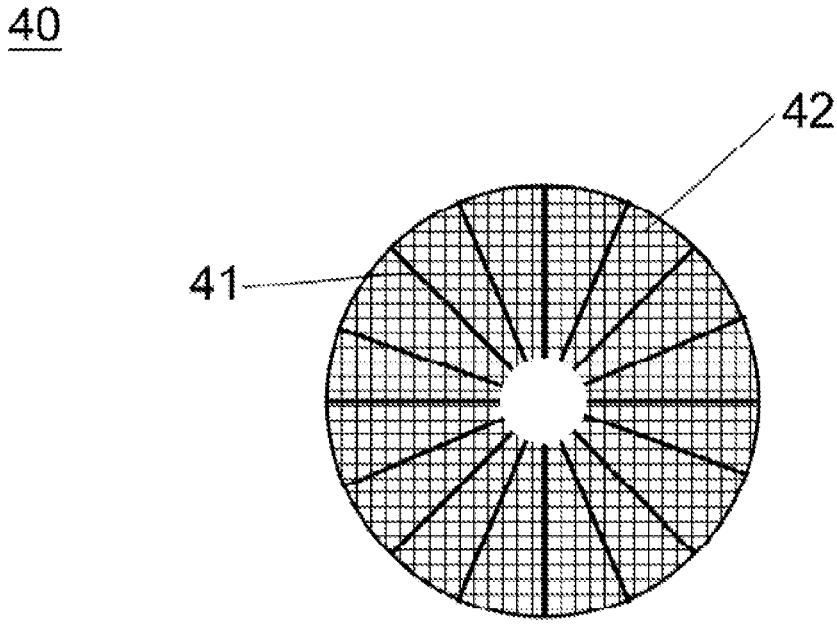
FIG. 4 is a front view of a polishing pad.

Referring to FIG. 4, which is a view of another preferred embodiment of first groove of polishing pad according to the present invention. As shown in FIG. 4, the first groove 41 is disposed on the polishing pad 40 with the center of circle of polishing pad 40 as center in direct line radiation toward the periphery of polishing pad 40, the first groove 41 and the second groove 42 are uniformly distributed over the polishing surface 40 respectively, and is thus able to make it easy for the slurry to be flung out with the centrifugal force function during the polishing step to prevent the polishing particles from remaining or depositing; the second groove 42 is disposed on the polishing pad 40 in grid pattern to ensure that the slurry can be evenly distributed on the polishing surface for forming a polishing pad 40 with two kinds of groove patterns.

Figure 5:
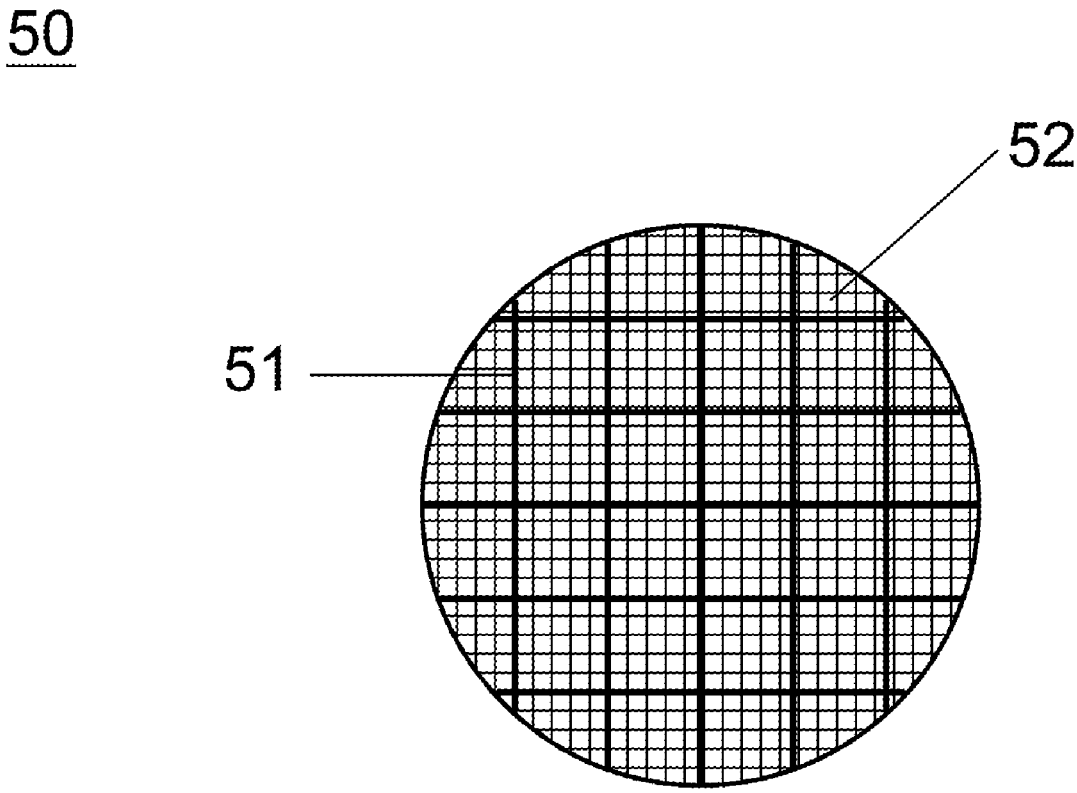
FIG. 5 is a front view of a polishing pad.

Referring to FIG. 5, which is a view of still another preferred embodiment of first groove of polishing pad according to the present invention. As shown in FIG. 5, the first groove 51 is disposed on the polishing pad 50 in grid pattern and the second groove 52 is also disposed on the polishing pad 50 in grid pattern, the first groove 51 and the second groove 52 are uniformly distributed over the polishing surface 50 respectively, and is thus able to ensure that the slurry can be evenly distributed on the polishing surface for forming a polishing pad 50 with two kinds of groove patterns.

What are described above are only preferred embodiments of the present invention and are not for limiting the scope of the present invention; and the above description can be understood and put into practice by those who are skilled in the art. Therefore any equivalent modifications and arrangements made without departing from the spirit disclosed by the present invention should be encompassed by the appended claims accorded with the broadest interpretation.

What is claimed is:

1. A polishing pad, said polishing pad including a polishing surface, a plurality of first grooves and a plurality of second grooves being formed on said polishing surface, wherein characteristic of said polishing pad being in that:

said first grooves are connected to said second grooves, one end of each of said first grooves and one end of each of said second grooves are connected to periphery of said polishing pad respectively, each of said first grooves has a uniform width and a uniform depth, each of said second grooves has a uniform width and a uniform depth, width of each of said first grooves being larger than that of each of said second grooves, depth of each of said first grooves being larger than that of each of said second grooves, density of each of said first grooves distributed over said polishing surface being smaller than that of each of said second grooves, and said first grooves and said second grooves being uniformly distributed over said polishing surface respectively.

2. The polishing pad according to claim 1, wherein each of said first grooves is disposed on said polishing pad with center of circle of said polishing pad as center in curved radiation toward periphery of said polishing pad.

3. The polishing pad according to claim 1, wherein each of said first grooves is disposed on said polishing pad with center of circle of said polishing pad as center in direct line radiation toward periphery of said polishing pad.

4. The polishing pad according to claim 1, wherein depth of each of said second groove is about 0.1 mm~1 mm.

5. The polishing pad according to claim 1, wherein depth of each of said first groove is about 0.2 mm~1.5 mm.

6. The polishing pad according to claim 1, wherein said polishing pad further includes a connecting surface for being connected to polishing surface of another polishing pad.

7. A polishing pad, said polishing pad including a polishing surface, a plurality of first grooves and a plurality of second grooves in grid pattern being formed on said polishing surface, wherein characteristic of said polishing pad being in that:

said first grooves and said second grooves in grid pattern are connected to each other, one end of each of said first grooves and two ends of each of said second grooves in grid pattern are connected to periphery of said polishing pad respectively, each of said first grooves has a uniform width and a uniform depth, each of said second grooves in grid pattern has a uniform width and a uniform depth, width of each of said first grooves being larger than that of said second grooves in grid pattern, depth of each of said first groove being larger than that of said second grooves in grid pattern, density of each of said first groove distributed over said polishing surface being smaller than that of said second grooves in grid pattern, and said first grooves and said second grooves in grid pattern being uniformly distributed over said polishing surface respectively.

8. The polishing pad according to claim 7, wherein each of said first grooves is disposed on said polishing pad with center of circle of said polishing pad as center in curved radiation toward periphery of said polishing pad.

9. The polishing pad according to claim 7, wherein each of said first grooves is disposed on said polishing pad with center of circle of said polishing pad as center in direct line radiation toward periphery of said polishing pad.

10. The polishing pad according to claim 7, wherein said first grooves are disposed on said polishing pad in grid pattern and two ends of each of said first grooves are connected to periphery of said polishing pad.

11. The polishing pad according to claim 7, wherein depth of said second grooves in grid pattern are about 0.4 mm~0.7 mm.

12. The polishing pad according to claim 7, wherein depth of each of said first grooves is about 0.5 mm~1.2 mm.

13. The polishing pad according to claim 7, wherein said polishing pad further includes a connecting surface for being connected to polishing surface of another polishing pad.

* * * * *